US010870296B2

(12) United States Patent
Capoia

(10) Patent No.: US 10,870,296 B2
(45) Date of Patent: Dec. 22, 2020

(54) APPARATUS FOR CONTROLLED MOTION OF PRINTING UNITS AND PACKAGE MAKING MACHINE INCORPORATING SUCH APPARATUS

(71) Applicant: Panotec S.R.L, Cimadolmo (IT)

(72) Inventor: Giuseppe Capoia, Cimadolmo (IT)

(73) Assignee: Panotec S.R.L., Cimadolmo (IT)

( * ) Notice: Subject to any disclaimer, the term of this patent is extended or adjusted under 35 U.S.C. 154(b) by 158 days.

(21) Appl. No.: 15/773,307

(22) PCT Filed: Oct. 28, 2016

(86) PCT No.: PCT/IB2016/056513
§ 371 (c)(1),
(2) Date: May 3, 2018

(87) PCT Pub. No.: WO2017/077439
PCT Pub. Date: May 11, 2017

(65) Prior Publication Data

US 2018/0319183 A1 Nov. 8, 2018

(30) Foreign Application Priority Data

Nov. 3, 2015 (IT) ..... 102015000068191

(51) Int. Cl.
*B41J 19/00* (2006.01)
*B41J 19/20* (2006.01)

(52) U.S. Cl.
CPC ..... *B41J 19/005* (2013.01); *B41J 19/202* (2013.01)

(58) Field of Classification Search
CPC ..... B41J 19/005; B41J 19/202
See application file for complete search history.

(56) References Cited

U.S. PATENT DOCUMENTS 4,487,518 A * 12/1984 Enrini ..... B41J 19/005 400/320
5,200,767 A * 4/1993 Tsukada ..... B41J 19/202 346/139 A (Continued)

FOREIGN PATENT DOCUMENTS

| | | | |
|---|---|---|---|
| CN | 102224015 | A | 10/2011 |
| EP | 0227251 | A2 | 7/1987 |
| JP | S6299178 | A | 5/1987 |

*Primary Examiner* — David H Banh
(74) *Attorney, Agent, or Firm* — The Watson IP Group, PLC; Jovan N. Jovanovic

(57) ABSTRACT

An apparatus (1) for controlled motion of one or more printing units (2) designed for printing images (I) on one or more faces (F) of a sheet material (M) that is designed to move in a feeding direction defining a longitudinal axis (L). The apparatus (1) is adapted to be associated with a machine (3) for cutting and creasing customized packages and comprises a stationary frame (10) defining an elongate transverse axis (T), at least one box-like support (12) for a corresponding printing unit (2), which is slidably mounted on transverse guide means (13) integral with the frame (10), drive means (26) for driving the box-like support (12) along transverse guide means (13), the drive means (26) comprise at least one section of a stationary and flexible belt (27) having a predetermined length (I) and end portions (28, 29) stably secured to the frame (10), as well as at least one powered roller (31) associated with the support (12), and having an intermediate portion (30) of the belt section (27) at least partially wound thereon for its rotation to promote the movement of the support (12) relative to the belt section (27). A machine (3) for cutting and creasing customized packages, comprising the apparatus for driving the printing units (2).

13 Claims, 5 Drawing Sheets

(56) References Cited

U.S. PATENT DOCUMENTS

| | | | | |
|---|---|---|---|---|
| 5,779,376 | A | 7/1998 | Seu | |
| 6,290,326 | B1 * | 9/2001 | Hipp | B41J 2/485 347/16 |
| 6,305,780 | B1 * | 10/2001 | Askren | B41J 19/005 347/14 |
| 6,464,416 | B1 | 10/2002 | Aoshima | |
| 6,896,430 | B2 * | 5/2005 | Williams | B41J 19/00 400/323 |
| 2009/0174749 | A1 * | 7/2009 | Kemma | B41J 3/543 347/37 |
| 2011/0122184 | A1 * | 5/2011 | Kimura | B41J 2/16508 347/14 |
| 2013/0324338 | A1 | 12/2013 | Huang et al. | |

* cited by examiner

APPARATUS FOR CONTROLLED MOTION OF PRINTING UNITS AND PACKAGE MAKING MACHINE INCORPORATING SUCH APPARATUS

FIELD OF THE INVENTION

The present invention generally finds application in the field of printing devices and particularly relates to an apparatus for controlled motion of printing units which are designed to print text or images on the surface of a sheet material, which apparatus is adapted to be associated with a machine for cutting and creasing customized packages.

The invention further relates to a machine for cutting, creasing and printing customized packages from a sheet material, which incorporates such apparatus for driving printing units.

BACKGROUND ART

Printing units with one or more inkjet heads for printing images or text on one face of relatively rigid sheet materials, such as corrugated cardboard or the like, have been long known in the art.

The printing units of the present invention are adapted to be installed preferably but without limitation on printing devices that are associated with a customized package making machine and can be employed for the so-called large-format printing.

These known devices comprise means for driving printing units, which are adapted to promote selective movement of the latter in a direction perpendicular to the direction of feed of the sheet material, to thereby control the position of the printhead relative to the surface of the sheet material to be printed.

JPS6299178 discloses a printhead drive apparatus, which comprises a belt or a wire wound around a motorized pulley and with ends fixed to the printhead carriage. The belt is tensioned by a pair of idle rollers, which are rigidly joined to the carriage and elastically biased by a spring.

U.S. Pat. Nos. 5,779,376 and 6,305,780 disclose respective printhead carriage drive apparatus, having a belt with end portions secured to the frame or the carriage respectively, and an intermediate portion interacting with a motorized pulley. The belt is held under tension by a spring secured to the frame, or by a plurality of appropriately pre-loaded return pulleys.

While the above prior art systems can eliminate printhead fluctuations, they are particularly designed to drive low-weight and small-size printheads, as used in small devices, e.g. printers or scanners.

Therefore, the above-mentioned apparatus cannot be employed in devices for printing large-format sheet materials, whose printheads and supports have very large masses and sizes.

In an attempt to obviate these drawbacks, special apparatus have been developed with the purpose of driving printing units for large-format sheet materials, which apparatus typically comprise a stationary frame, at least one box-like support for a printing unit, which is slidingly mounted to guide means rigidly joined to the frame and drive means for driving a box-like support along the guide means.

The frame has one or more elongate seats which house a box-like support removably connected to the printing unit, and slidingly mounted to guide means that extend along a respective seat and allow the printing unit to move on the surface of the material to be printed.

The drive means comprise a rack-and-pinion mechanism. Furthermore, in order to prevent the sheet material from sticking at the seat, two flexible belts are provided, with ends connected to respective idle rollers attached to the frame and the support.

A first drawback of this prior art arrangement is that the drive apparatus has a great number of parts, which add to its assembly and handling complexity.

Furthermore, this apparatus has a very high cost and requires constant maintenance because, in order to prevent seizure and wear of the pinion and/or the rack, this mechanism has to be periodically lubricated.

A further drawback of this prior art arrangement is that periodic lubrication of the pinion and the rack may cause lubricant dripping, with drops possibly falling on other parts of the device or the surrounding environment.

Also, constant lubrication of the mechanism is not sufficient to prevent the wear of the pinion and rack, which constantly contact each other, and this may lead to the formation of clearances that will reduce positioning accuracy of the printing unit and, even worse, seizure of parts.

Another serious drawback of this arrangement is that this apparatus uses winding/unwinding rollers connected to the ends of the belt, which have a limited life.

Therefore, any malfunctioning of these rollers might affect tensioning of the belt during operation of the device, thereby causing damages to the sheet material or the printheads.

Technical Problem

In view of the prior art, the technical problem addressed by the present invention consists in providing an apparatus for controlled motion of inkjet printheads for printing images on one or more faces of a sheet material, that is particularly simple and reliable, requires little maintenance, facilitates the feed of the sheet material and ensures fast and accurate movement of the printheads in their drive direction.

DISCLOSURE OF THE INVENTION

The object of the present invention is to solve the aforementioned technical problem and obviate the above drawbacks, by providing an apparatus for controlled motion of printing units designed to print graphics on one or more faces of a sheet material, that is highly efficient and relatively cost-effective.

A particular object of the present invention is to provide an apparatus for controlled motion of printing units as mentioned above, that has a relatively simple construction with a small number of parts.

Another object of the present invention is to provide an apparatus for controlled motion of printing units designed to print graphics on one or more faces of a sheet material, that can displace the printing unit with high accuracy in its direction of displacement.

A further object of the present invention is to provide an apparatus for controlled motion of printing units designed to print graphics on one or more faces of a sheet material, that is highly reliable and has a long life.

A further object of the present invention is to provide an apparatus for controlled motion of printing units designed to print graphics on one or more faces of a sheet material, that is highly reliable and has a long life.

These and other objects, as better explained hereafter, are fulfilled by an apparatus for controlled motion of a printing unit that is designed to be installed on customized package making machines as defined in claim 1.

Particularly, the apparatus comprises at least one support for one or more printing units and means for driving the support which comprise at least one stationary and flexible belt section having a predetermined length with end portions stably secured to the frame, as well as at least one powered roller associated with the support, and having an intermediate portion of the belt section at least partially wound thereon for its rotation to promote the movement of the support relative to the belt section.

With this arrangement, the apparatus has a simplified construction, a smaller number of details and a high reliability and is also able to more easily and accurately control the movement of the printing units.

In a further aspect, the invention relates to a customized package making machine incorporating the aforementioned drive apparatus, as defined in claim 13.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of an apparatus for controlled motion of a printing unit designed to be installed in customized package making machines and such customized package making machine, which are described as a non-limiting example with the help of the annexed drawings, in which.

DETAILED DESCRIPTION OF A PREFERRED EXEMPLARY EMBODIMENT

Particularly referring to the figures, numeral 1 generally designates and illustrates an apparatus for controlled motion of a printing unit 2 which is designed to print graphics I on one or more faces F of a sheet material M moving in a longitudinal direction of feed L.

Figure 1:
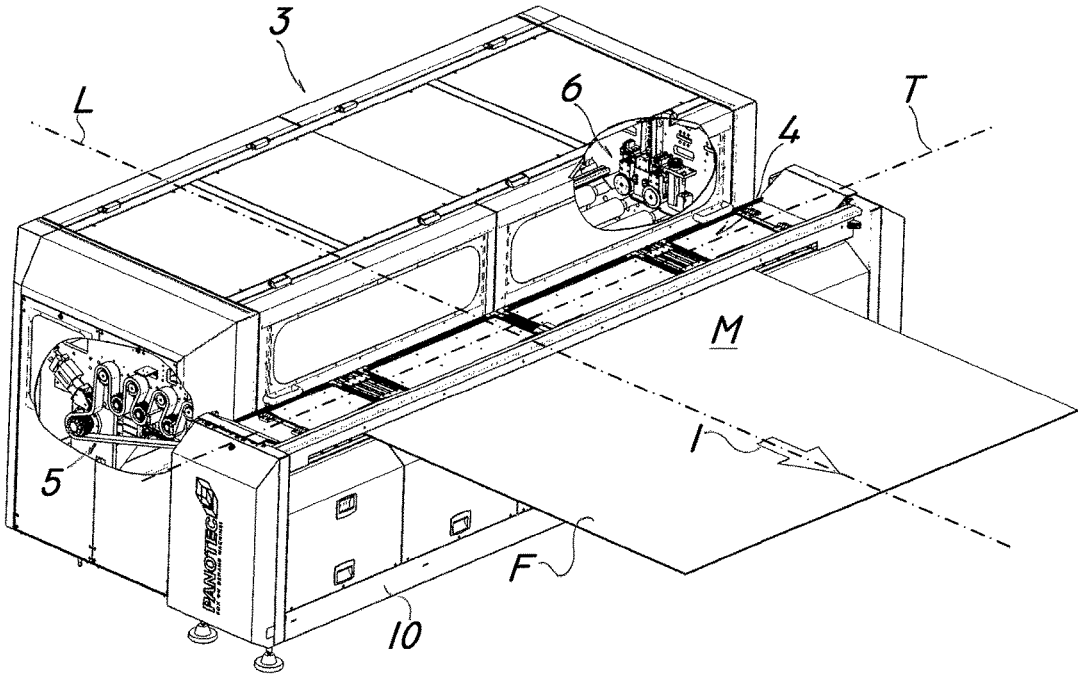
FIG. 1 is a perspective view of a customized package making machine which comprises a printing device with an apparatus for controlled motion of driving the printing units according to the invention installed therein.
Figure 2:
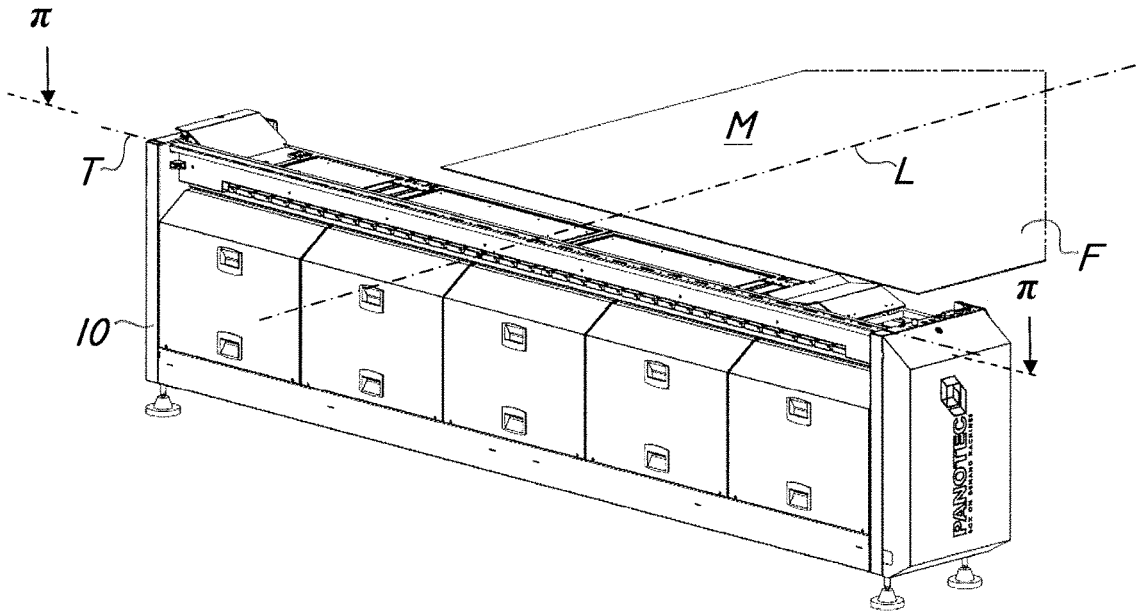
FIG. 2 is a perspective view of the printing device of FIG. 1.

Particularly, the apparatus 1 may either operate in stand-alone mode or be associated with a machine 3, as shown in FIG. 1, for making packages from a rigid or semi-rigid sheet material M, e.g. corrugated cardboard or the like.

As is known in the art, this machine 3 has a substantially horizontal feeding plane 4 for the sheet material M, means 5 for longitudinally feeding the sheet material M on such plane 4, and cutting and creasing means 6 for making a plurality of cuts and/or fold lines on the material M to form a package of a predetermined, user-selectable size.

The machine 3 further comprises at least one printing unit 2, situated upstream or downstream from the cutting and creasing means 6 and having one or more inkjet printheads 7 substantially coplanar with the feed plane 4, for printing text and/or graphics I on one face F of the sheet material M that is being cut and creased.

Each printing unit 2 may comprise a box-like enclosure 8 having a top wall 9 with at least one inkjet printhead 7 secured thereto and interacting with one face F of the material M to be printed.

For example, in the illustrated configuration, each printing unit 2 houses a pair of inkjet printheads 7 therein, which are longitudinally spaced apart by a predetermined pitch and partially superimposed in a transverse direction.

The printing units 2 are adapted to move in respective transverse directions for printing the graphics I in any position of the sheet material M.

The movement of the printing units 2 is promoted by a drive apparatus 1 of the invention, which comprises a preferably box-like stationary frame 10 having an elongate transverse axis T.

Such frame 10 may have a top surface 11 defining a slide plane $\pi$ for the sheet material M which is substantially coplanar with the feeding plane 4 of the machine 3.

Figure 9:
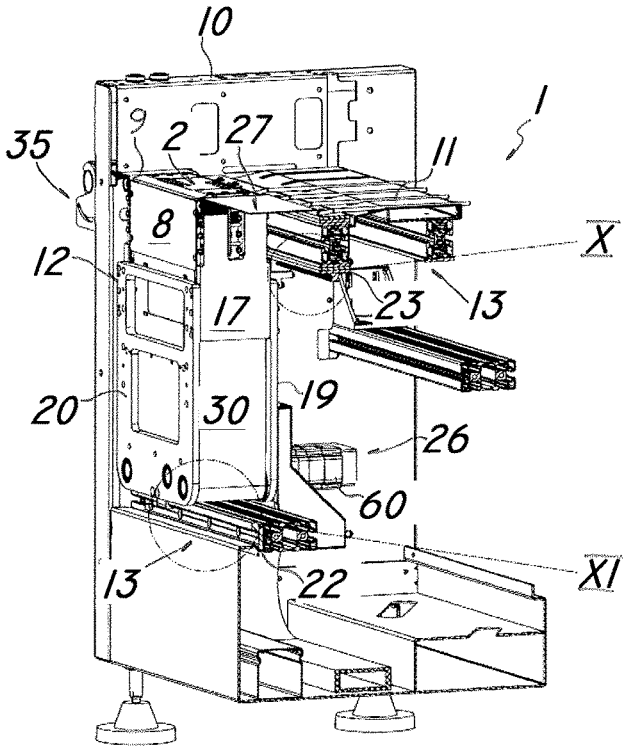
FIG. 9 is a broken-away perspective view of a further detail of FIG. 3.
Figure 10:
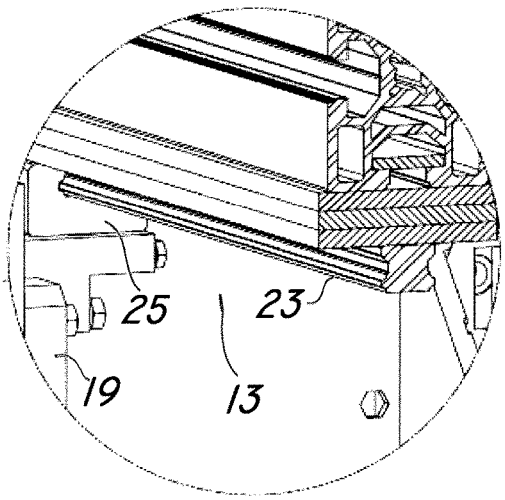
FIGS. 10 and 11 are enlarged views of respective details of FIG. 9.
Figure 11:
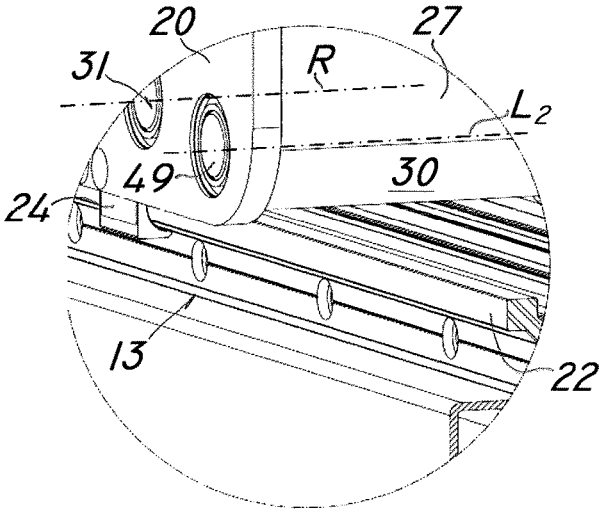

At least one box-like support 12 is also provided, which is slidably mounted on transverse guide means 13 that are integral to the frame 10, as shown in FIGS. 9 to 11. Furthermore, the support 12 has a cavity 14 for removably housing the enclosure 8 of a printing unit 2.

Each support 12 may be accommodated in a transverse seat 15 formed in the frame, and having the transverse guide means 13 mounted therein.

Such seat 15 is open at its top for the supports 12 to be able to transversely slide therein and has a depth $p_1$ that can maintain the top wall 9 of each printing unit 2 substantially coplanar with the slide plane $\pi$.

This, the printheads 7 will be held in a position in which they face the slide plane $\pi$ to print the bottom face F of the sheet material M by upward ejection of ink.

Quick connection means 16 may be further provided, as shown in FIG. 9, for snap-fit connection of the enclosure 8 to the support 12.

The support 12 may be formed of two longitudinal side walls 17, 18 and two transverse side walls 19, 20, which are substantially vertically oriented and are joined together and to a substantially horizontal bottom wall 21.

Furthermore, the guide means 13 may comprise at least one transverse guide 22, 23 which is stably secured to the frame 10 and/or one or more sliding blocks 24, 25, which are slidingly mounted to a respective guide 22, 23 and are rigidly joined to the support 12.

As best shown in FIGS. 9, 10 and 11, the guide means 13 may comprise a transverse guide 11 located below the bottom wall 21 of the box-like support 12 and an additional transverse guide 23 that faces a transverse wall 19 of the support 12.

At least one sliding block 24, 25 slides on these guides 22, 23, and is fixed to the bottom wall 21 and the transverse wall 19 of the support 12 respectively.

Conveniently, the apparatus 1 comprises drive means 26 for promoting the movement of the box-like support 12 along the transverse guide means 13.

Particularly, for the printheads 7 to be able to print the material M across its width, the drive means 26 may promote the movement of the support 12 between two transverse end positions, whose distance from each other is equal to or greater than the maximum size of the sheet material M.

According to a peculiar aspect of the invention, as best shown in FIGS. 3 to 9, the drive means 26 comprise at least one stationary and flexible belt section 27 having a predetermined length I with end portions 28, 29 designed to be stably secured to the frame 10.

Furthermore, the belt 27 have a corresponding intermediate portion 30, at each box-like support 12, which is at least partially wound on at least one powered roller 31 associated with the box-like support 12 and adapted to promote, by its rotation, the movement of the support 12 relative to the belt section 27.

Figure 4:
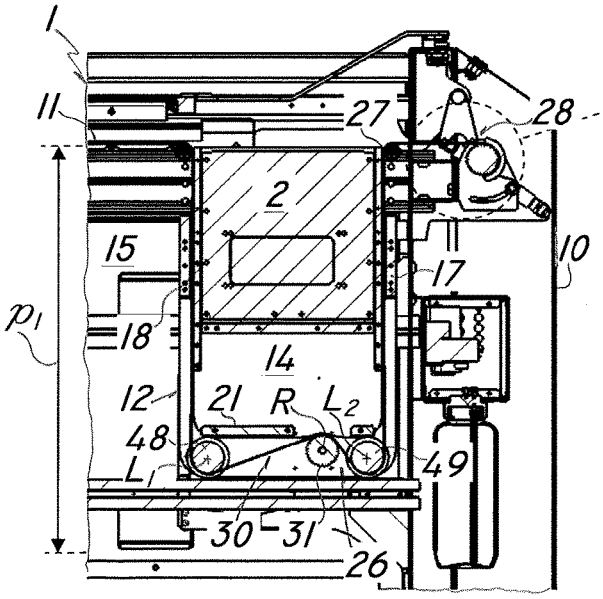
FIG. 4 is a lateral broken-away view of a first detail of FIG. 3.
Figure 5:
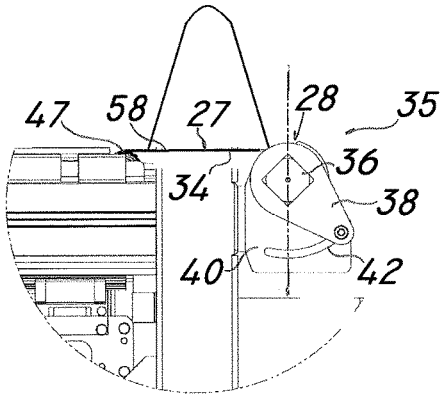
FIG. 5 is an enlarged view of a part of FIG. 4.
Figure 6:
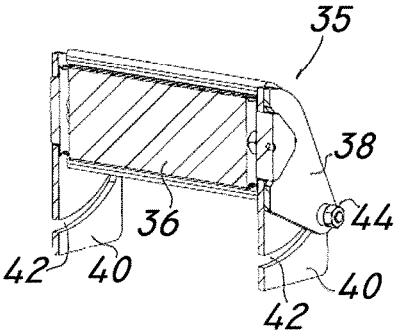
FIG. 6 is a broken away perspective view of the detail of FIG. 4.

A best shown in FIGS. 4, 5 and 9, the ends 28, 29 of the belt 27 are stably fixed to corresponding end areas 32, 33 of the frame 10.

Figure 7:
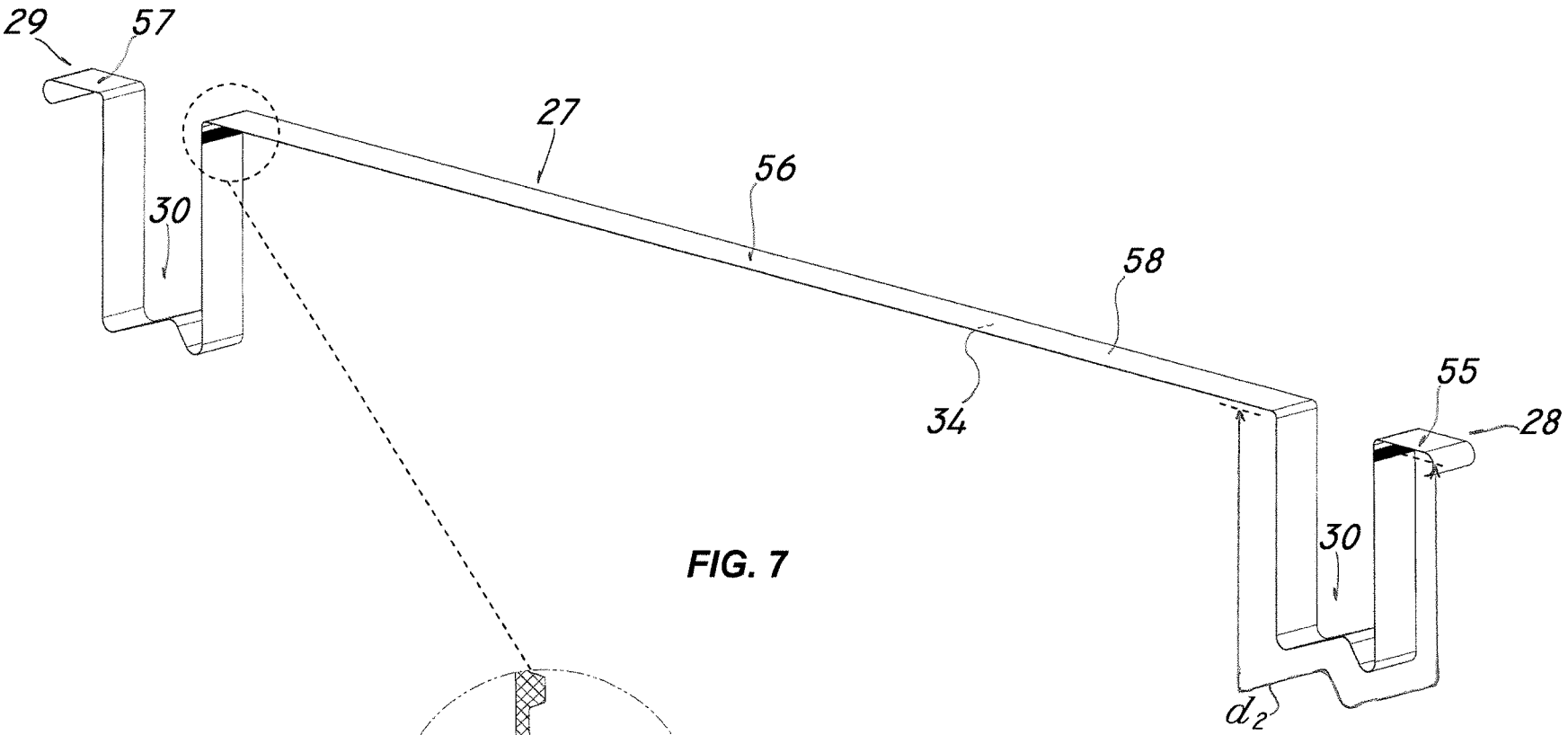
FIG. 7 is a perspective view of a third detail of FIG. 2.
Figure 8:
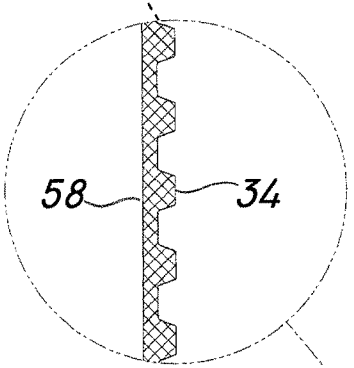
FIG. 8 is an enlarged view of a portion of the detail of FIG. 7.

Preferably, as best shown in FIGS. 7 and 8, the belt 27 may have a toothed interior surface 34, and may be equipped with tensioning means 35 associated with the end areas 32, 33 of the frame 10.

Particularly, each end 28, 29 of the belt 27 may be wound around a respective cylindrical toothed detent 36, 37 which is rigidly joined to a bracket 38, 39 that pivots relative to the stationary support 40, 41 on which a semicircular groove 42, 43 is formed.

The movement of the bracket 38, 39 will cause the detent 36, 37 to rotate and, as a result, the belt 27 will be tensioned. Furthermore, the belt 27 may be held under tension, by locking the bracket 38, 39 to the support 40, 41, i.e. by tightening a bolt 44, 45 into the groove 42, 43.

Figure 12:
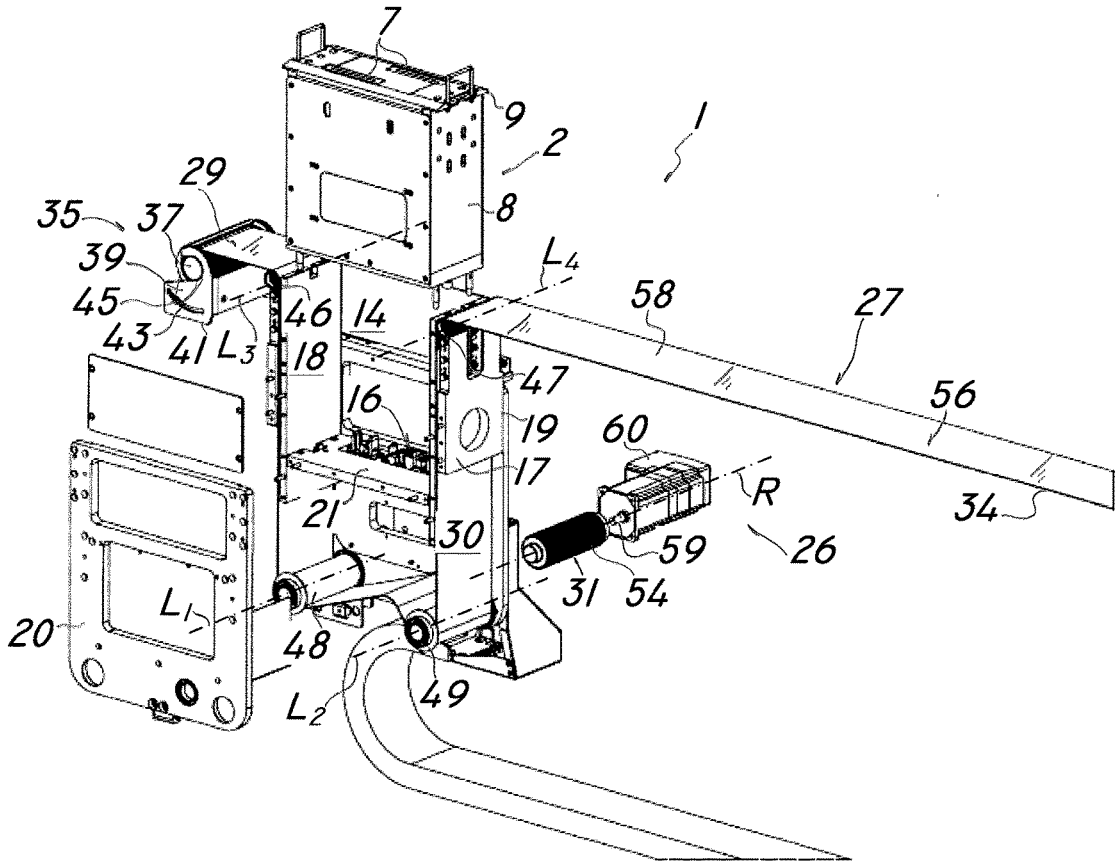
FIG. 12 is an exploded perspective view of the detail of FIG. 4.

Conveniently, the apparatus 1 may comprise a pair of upper return rollers 46, 47, located outside the longitudinal walls 17, 18 of the support 12, as shown in FIG. 12, and a pair of lower return rollers 48, 49, located outside the bottom wall 21 thereof.

These pairs of rollers 46, 47; 48, 49 may be idly mounted to respective longitudinal axes of rotation $L_1$, $L_2$, $L_3$, $L_4$ and may have corresponding outer surfaces 50, 51, 52, 53, designed for interaction with the belt 27.

Figure 3:
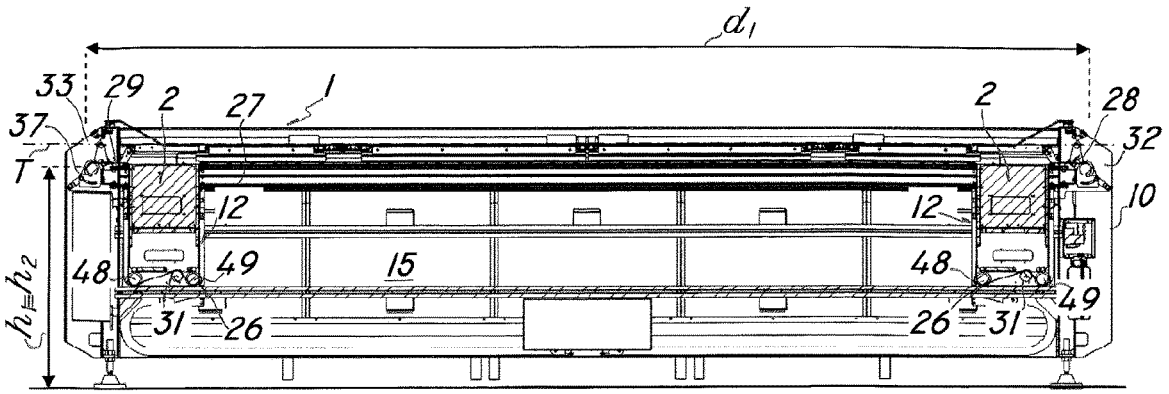
FIG. 3 is a broken-away front view of the device of FIG. 2.

As best shown in FIGS. 3 to 5, the pair of upper rollers 46, 47 may be mounted outside the longitudinal walls 17, 18 of the support 12, for the intermediate portion 30 of the belt 27 to entirely wrap them and the bottom wall 41.

Furthermore, the powered roller 31 may be interposed between the pair of lower rollers 48, 49.

The presence of the rollers 46, 47; 48, 49 will impart a substantially omega shape (ω) to the intermediate portion 30 and the belt 27 will be wound around the lower rollers 48, 49 from the bottom and around the powered roller 31 from the top.

Furthermore, as best shown in FIG. 7, the belt section 27 may have a total length $I_t$ substantially equal to the sum of the distance $d_1$ between the end areas 32, 33 of the frame 10 and the lengths $d_2$ of each substantially omega-shaped intermediate portion 30 ($I_t=d_1+2d_2$)

The powered roller 31 may rotate about the corresponding longitudinal axis of rotation R and may have an outer peripheral surface 45 with a high friction coefficient such that it may grip onto the inner surface 34 of the belt 27.

Preferably, the belt 27 has a toothed inner surface 34, and the powered roller 31 will also have a toothed outer surface 54 with a corresponding pitch.

Advantageously, the height $h_1$ of the pair of upper rollers 46, 47 from the ground may be substantially equal to the height $h_2$ of the detents 36, 37 from the ground.

Thus, as shown in FIG. 7, the belt 27 will have two or more substantially straight portions 55, 56, 57 parallel to the ground, which are designed to close the top of the seat 15 of the frame 10 in which the support 12 is slidingly mounted.

Therefore, the outer surface 58 of the belt 27 will be substantially coplanar with the slide plane π which will prevent the sheet material M from encountering gaps or void in its direction of feed L and from sticking at the seat 15.

Preferably, as best shown in FIGS. 8 and 9, the roller 31 may be mounted to the rotating shaft 59 of an electric motor 60, which will be directly secured to the transverse wall 19 of the support 12.

The apparatus 1 may further comprise electronic control means, not shown, which are operably connected to the electric motor 62 to control its actuation and promote accurate displacement of the support 12 along the transverse guide means 13.

In a preferred configuration of the invention, as shown in the figures, the apparatus 1 may comprise a plurality of supports 12 accommodated within a single seat 15, each being slidingly movable on common guide means 13.

Particularly, a single common belt section 27 may be provided, which will be adapted to be peripherally wound around all the box-like supports 12 within the seat 15, to define respective intermediate portions 30 for each of them.

A respective powered roller 31 will be mounted to each support 12, to allow for independent longitudinal movement of each printing unit 2

Figure 13:
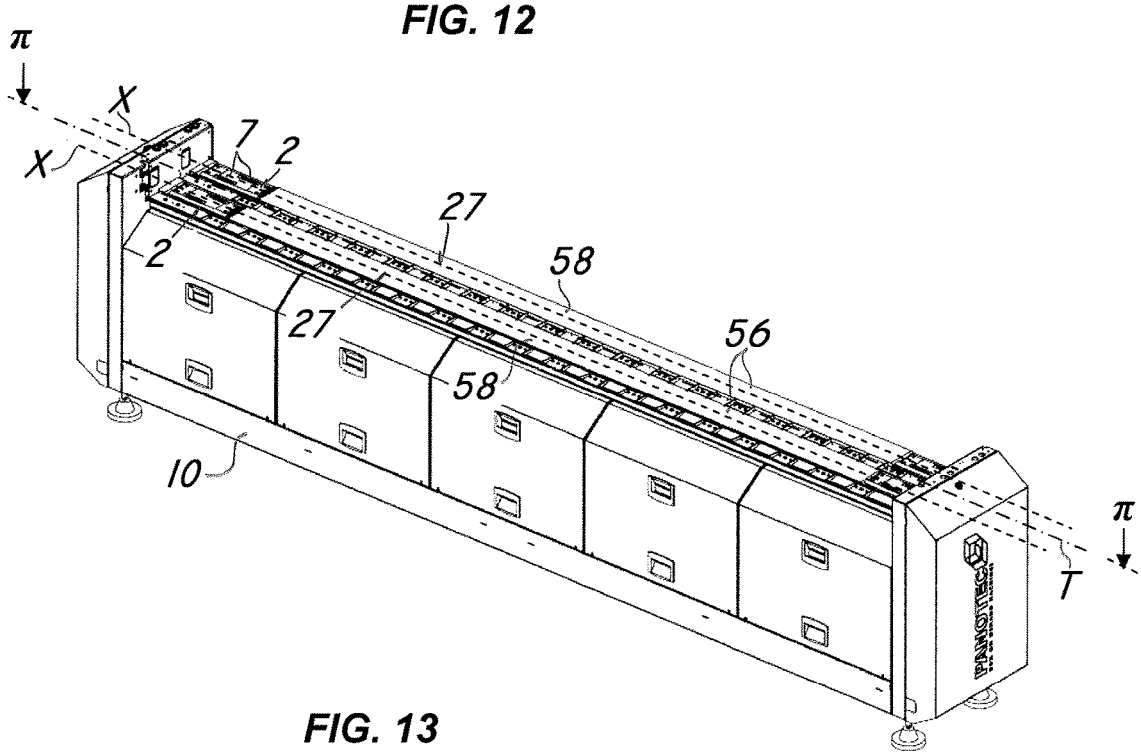
FIG. 13 is a perspective view of one embodiment of a printing device with an apparatus for driving the printing units according to the invention installed therein.

In an alternative configuration of the invention, as shown in FIG. 13, the frame 10 may comprise a plurality of longitudinally offset seats 15 with one or more box-like supports 12 and a single belt section 27 slidingly mounted in each of them.

Thus, the powered rollers 31 associated with the supports 12 in different seat 15 will be adapted to interact with distinct belt sections 27.

In a further aspect, the invention provides a customized package making machine 3 having at least one printing unit 2 associated with a drive apparatus 1 as described above.

The apparatus and the machine of the invention are susceptible to a number of changes or variants, within the inventive concept disclosed in the appended claims. All the details thereof may be replaced by other technically equivalent parts, and the materials may vary depending on different needs, without departure from the scope of the invention.

While the apparatus and the machine have been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be manufactured on an industrial scale in factories for production of machines designed for processing of semirigid sheet products, such as cardboard or the like, or for production of package-forming machines.

The invention claimed is:

1. An apparatus for controlled motion of one or more printing units designed for printing images on one or more faces of a sheet material, such as paper or cardboard, that is designed to move in a feeding direction defining a longitudinal axis, which apparatus is adapted to be associated with a machine for cutting and creasing customized packages, and comprises:

a stationary frame defining an elongate transverse axis, and having transversely spaced end areas;

at least one box-like support for a corresponding printing unit which is slidably mounted on transverse guide mechanism integral with said frame; and a drive mechanism for controlled motion of said at least one box-like support along said transverse guide mechanism, said drive mechanism comprising a belt and at least one powered roller associated with said at least one box-like support;

wherein said belt comprises at least one stationary and flexible section having a predetermined length, said belt section comprising end portions stably secured to said end areas of said frame, and a corresponding intermediate portion which is peripherally wound around the at least one box-like support and partially wound on said powered roller for rotation of the latter to promote movement of said at least one box-like support relative to said belt section.

2. An apparatus as claimed in claim 1, wherein the apparatus further comprises a tensioning mechanism for tensioning said belt section, which are associated with said end areas of said frame.

3. An apparatus as claimed in claim 1, wherein said at least one box-like support comprises a pair of upper return rollers and a pair of lower return rollers which are horizontally and vertically offset, for tensioning said belt section and for imparting at least one substantially omega-shaped path to said intermediate portion, moving parallel to said transverse guide mechanism.

4. An apparatus as claimed in claim 3, wherein a total length of said belt section is substantially equal to a sum of a distance between said end areas of said frame and lengths of an extension of each substantially omega-shaped intermediate portion.

5. An apparatus as claimed in claim 4, wherein said upper and lower return rollers are idly mounted on respective longitudinal axes and have outer cylindrical surfaces adapted for interaction with opposed surfaces of said belt section.

6. An apparatus as claimed in claim 3, wherein said at least one powered roller is interposed between said pair of lower return rollers and has a substantially longitudinal axis of rotation, so that said belt section will be wound around said lower return rollers from a bottom and around said powered roller from a top.

7. An apparatus as claimed in claim 1, wherein said at least one powered roller has an outer surface with a high friction coefficient to grip unto said belt section and is driven by an electric motor, which is rigidly joined to said at least one box-like support.

8. An apparatus as claimed in claim 7, wherein said belt section and said motorized roller have toothed surfaces at an inner surface and an outer surface thereof respectively, which surfaces are in mutually facing contact.

9. An apparatus as claimed in claim 1, wherein said guide mechanism comprise one or more transverse guides, which are secured to said frame and are adapted to slidingly support one or more sliding blocks which are rigidly joined to said at least one box-like support.

10. An apparatus as claimed in claim 1, wherein the apparatus further comprises two or more juxtaposed box-like supports with respective powered rollers designed to interact with a single common belt section.

11. An apparatus as claimed in claim 1, wherein the apparatus further comprises two or more longitudinally offset box-like supports associated with respective powered rollers for interaction with corresponding separate belt sections.

12. A machine for cutting and creasing customized packages from a sheet material such as paper, cardboard or the like, comprising:

a feeding plane for the sheet material along a longitudinal axis;

cutting and creasing mechanism making cuts and/or fold lines on the sheet material placed on said feeding plane;

at least one printing unit, situated upstream or downstream from said cutting and creasing mechanism and having at least one inkjet printhead for printing customized graphics on one face of the sheet material;

characterized in that it comprises an apparatus for driving said one or more printing units according to claim 1.

13. A machine as claimed in claim 12, wherein said at least one printing unit has a plurality of inkjet heads which are longitudinally offset by a predetermined pitch and are at least partially transversely superimposed.

* * * * *